United States Patent [19]

Lundblad

[11] 4,045,017

[45] Aug. 30, 1977

[54] METHOD OF AND AN APPARATUS FOR COLLECTING VALUABLE SHEET-SHAPED OBJECTS

[76] Inventor: Leif Jörgen Ingemar Lundblad, Haradsvagen 102, Huddinge, Sweden

[21] Appl. No.: 573,769

[22] Filed: May 1, 1975

[30] Foreign Application Priority Data

May 9, 1974 Sweden ..... 7406187

[51] Int. Cl.[2] ..... B65H 29/46

[52] U.S. Cl. ..... 271/181; 194/4 E

[58] Field of Search ..... 271/177, 180, 181; 209/80.5; 194/1 B, 4 E

[56] References Cited

U.S. PATENT DOCUMENTS

| | | | |
|---|---|---|---|
| 1,603,294 | 10/1926 | Reiser | 271/181 |
| 2,659,907 | 11/1953 | Kramer | 271/181 X |
| 2,815,950 | 12/1957 | Kramer | 271/181 |
| 3,148,879 | 9/1964 | Kistner | 271/181 X |
| 3,188,945 | 6/1965 | Renaner | 271/181 X |
| 3,301,554 | 1/1967 | Voss | 271/177 |
| 3,312,225 | 4/1967 | Irwin | 209/80.5 |
| 3,747,754 | 7/1973 | Nix | 209/80.5 |

*Primary Examiner*—Richard A. Schacher
*Attorney, Agent, or Firm*—Burns, Doane, Swecker & Mathis

[57] ABSTRACT

An apparatus for collecting banknotes in a vending machine is disclosed. The apparatus includes a removable cassette having a banknote intake opening, the cassette being closed and locked automatically when removed from the apparatus. The cassette also shows slot-like wall openings for the insertion of thin actuating fingers for pushing previously collected banknotes away from the intake opening to provide a free space for the next banknote to be fed into the cassette. After said next banknote has been received in the cassette, the fingers are withdrawn, such that the previously collected banknotes are put together with the banknote received due to the action of spring means in the cassette.

12 Claims, 5 Drawing Figures

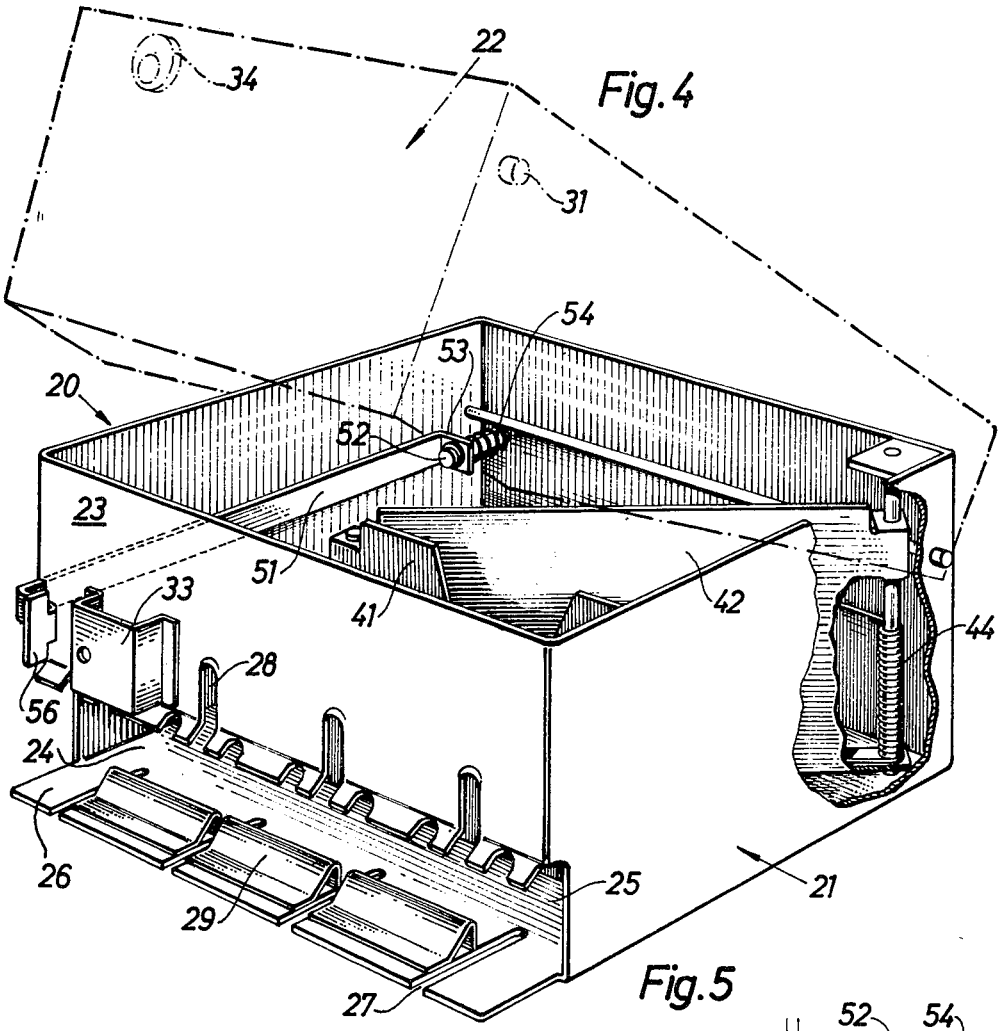
Fig. 4
Fig. 5
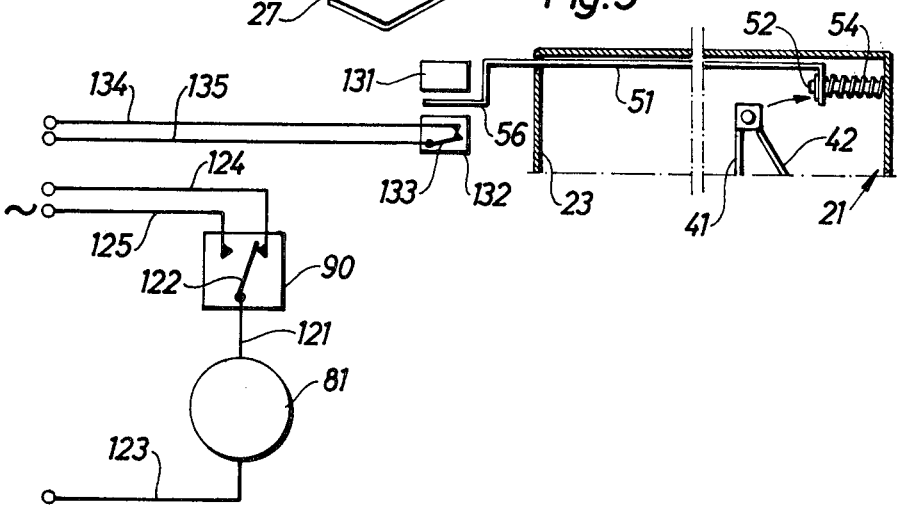

METHOD OF AND AN APPARATUS FOR COLLECTING VALUABLE SHEET-SHAPED OBJECTS

This invention relates to collecting sheet-shaped objects representing a value, such as banknotes, checks, tickets and the like, in a container or box, preferably a lockable casette.

Particularly in connection with vending machines for goods (for instance gasoline stations with an automatic prepayment unit) or for money (for instance a so-called bill changer) there is a need of collecting valuable sheet-shaped objects, such as banknotes, fed into the machine, in a container, such that the objects can be easily fetched by an operator at intervals.

Until now, the containers of vending machines in use mostly are simply a box or room in the machine, into which the objects fall freely after having been checked or verified as to accuracy. When the objects are to be fetched, the operator unlocks a cover of the machine and collects the objects by hand in order to transport them to a bank for instance. Obviously, this procedure has several drawbacks; it is time-consuming, makes a hold-up easier, leaves the operator in a difficult situation should there be any discordance between the number of objects registered in the vending machine and the number of objects brought in by the operator, etc.

Therefore, the present invention aims at providing a method of and an apparatus for collecting sheet-shaped objects representing a value in a container, particularly in connection with a vending machine, whereby the above-mentioned drawbacks are removed and whereby other advantages are achieved, such as the possibility of using a container in the form of a lockable cassette.

Thus, according to a first aspect of the invention there is provided a method of receiving and collecting sheet-shaped objects representing a value, for instance banknotes, checks, tickets, tokens and the like, in a container particularly arranged in a vending machine and particularly being a lockable cassette, said objects being fed successively into said container through an intake opening, the method being characterized by compressing and/or displacing existing objects in the container, before feeding in an object, such that a free space is provided in the container adjacent to said intake opening; feeding at least one object to be collected into said free space into a predetermined position; causing said existing objects in the container to return substantially to the same position as before said compressing and/or displacing, such that the object fed in is put together with said existing objects; and repeating the above-mentioned steps for the next object to be collected. In order to achieve said putting together the existing, that is previously connected objects in the container suitably are subjected to resilient push action towards the intake opening. Advantageously, the free space is provided by introducing actuating means into the container and pushing said existing objects thereby in a direction away from said intake opening against said resilient push action. Particularly when the container is a lockable box or casette, the actuating means are introduced through small openings in at least one of the walls of the container.

According to a second aspect of the invention there is provided an apparatus for receiving and collecting sheet-shaped objects representing a value, such as banknotes, checks, tickets, tokens and the like, in a container, the apparatus being particularly suitable for use in connection with a vending machine and including means for feeding successively received objects through an intake opening of the container, the apparatus being characterized in that it comprises actuating means for temporarily compressing and/or displacing existing objects in the container, such that a free space is provided in the container adjacent said intake opening, said feeding means being arranged to feed at least one object into said free space, such that said object will be put together with said existing objects when the temporary compressing and/or displacing action of said actuating means stops. Preferably, the container includes resilient or spring means for pushing existing objects in the container towards the intake portion of the container to keep said objects stacked and to put said objects together with an object fed in through the intake opening after the action of said actuating means has ceased. According to a preferred embodiment said actuating means include a number of finger-shaped means movably suspended outside of the container, the container being provided with openings corresponding to said finger-shaped means in at least one wall, and means for displacing said finger-shaped means through said openings into engagement with said existing objects to compress and/or displace said objects in order to provide said free space. Also, the container preferably is a lockable casette which can be removed from the apparatus in a locked condition, thereby making an unauthorized manipulation of the objects collected therein impossible.

The invention will be further described in relation to an examplary embodiment and with reference to the accompanying drawings, in which:

FIG. 4 is a perspective view, partly in section and partly diagrammatic, of the casette of the apparatus illustrated; and FIG. 5 is a schematic circuit diagram illustrating control functions of said feeding means and said drive means, means for indicating completely filled casette being showed schematically.

Figure 1:
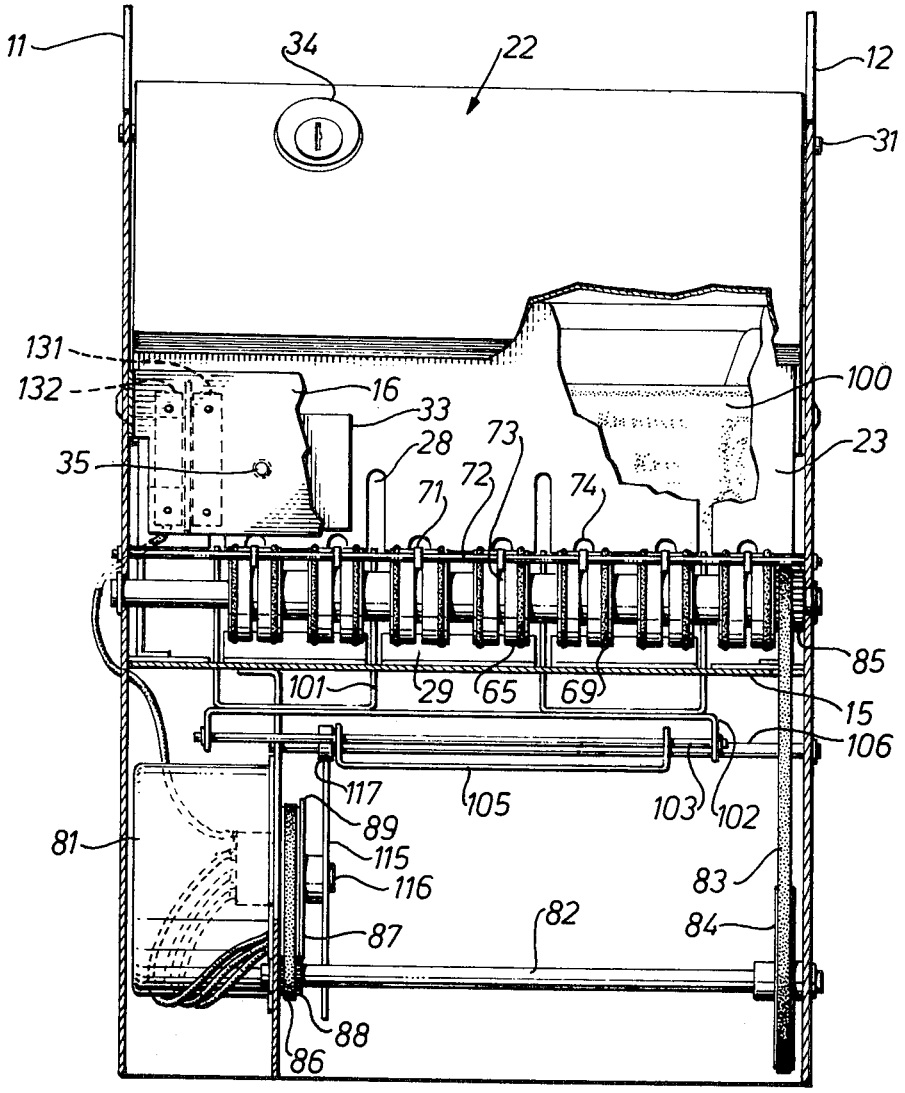
FIG. 1 is a front elevational view of an casette apparatus according to the invention, portions of feeding means being omitted as well as a lower front plate of the frame structure in order to better illustrate drive and actuating means.

The apparatus according to FIGS. 1–5 is intended for collecting banknotes in a vending machine, particularly a pre-payment unit of a gasoline station, including a conventional banknote verifier and conventional banknote feeding means for feeding verified banknotes to the apparatus according to the invention. Since said banknote verifier and said feeding means do not constitute any part of the present invention, they have not been shown, nor will they be further described. However, as an example, said banknote verifier may be one manufactured by Ardac Inc., Ohio, U.S. Under the trade name Ardac Mark 6, Model SV-10 ADD.

The apparatus disclosed essentially includes a frame structure 10 supporting banknote feeding means, actuating means and drive means, and a lockable casette 20 for receiving and collecting banknotes, the frame structure being designed such that the casette easily can be received in and removed from a banknote receiving and collecting position therein.

The frame structure includes two vertical parallel side plates 11, 12, a lower plate 13 interconnecting the lower front edges of said side plates, a lower back plate 14 interconnecting the lower back edges of said side plates and a horizontal casette supporting plate 15 interconnecting the upper edges of said front and back plates as well as said side plates. Also, the frame structure includes an upper front cross element 16. Thus, the frame structure 10 defines an upper rectangular room open rearwards for receiving the casette 20 and a lower room, below said upper room, for locating actuating and drive means, as will be described in more detail later on.

The casette 20 (FIG. 4) includes a parallelepipedal box 21, open upwards, and a cover 22 turnably attached to the rear end of the box 21. The front wall 23 of the box is provided with a lower intake opening 24 extending over the entire width of the front wall at the bottom wall 25 of the box. The bottom wall 25 has a forward extension 26, in which four longitudinal slots 27 are provided. Said slots 27 extend a small distance into the box 21. The front wall 23 is provided with four corresponding slots 28 extending vertically upwards from said intake opening 24 and being aligned with said bottom wall slots 27. Between said bottom wall slots 27 there are provided three guide elements 29 inclined rearwards upwards and each having a vertical back surface in alignment with the front wall 23 of the box.

The cover 22 of the casette 20 is extended and includes depending front and side plates so as to completely cover said bottom wall extension 26, and, consequently, the intake opening 24 when turned down into closed position. Said depending side plates each has a projecting guide pin 31, the reasons of which will be explained later on.

Figure 2:
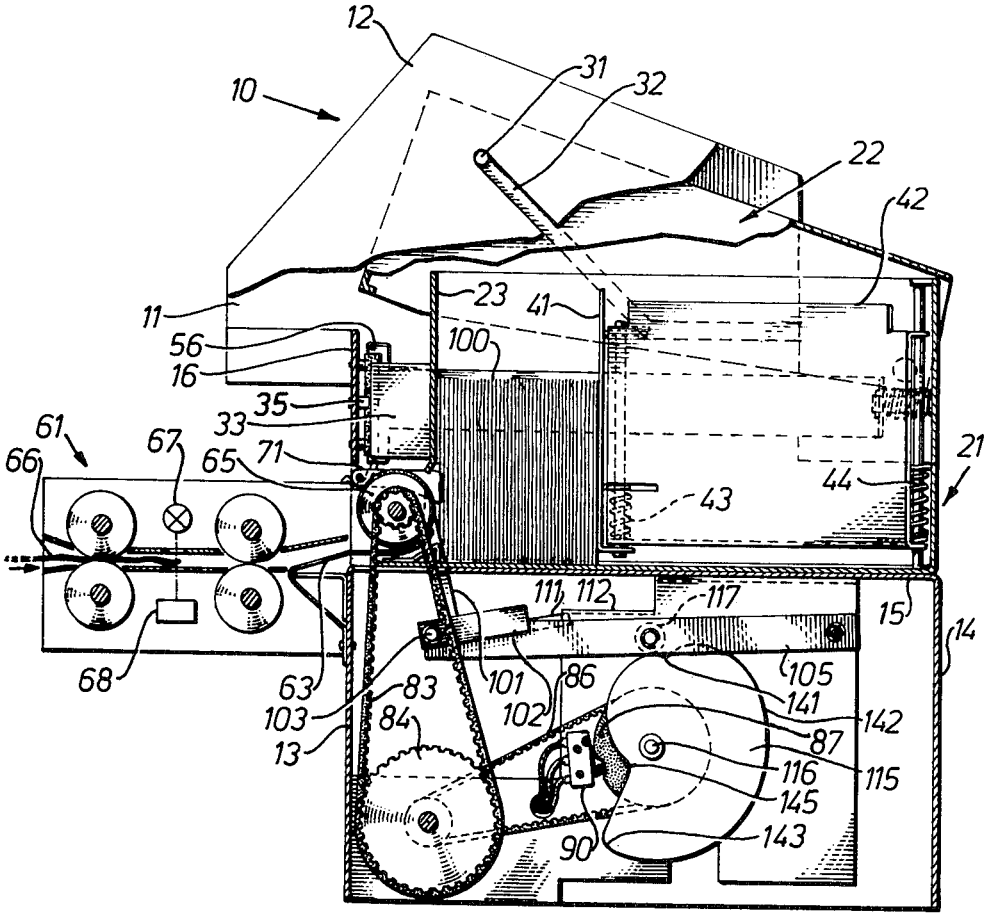
FIG. 2 is a side elevational sectional view of the apparatus of FIG. 1 illustrating a starting condition of said drive and actuating means.
Figure 3:
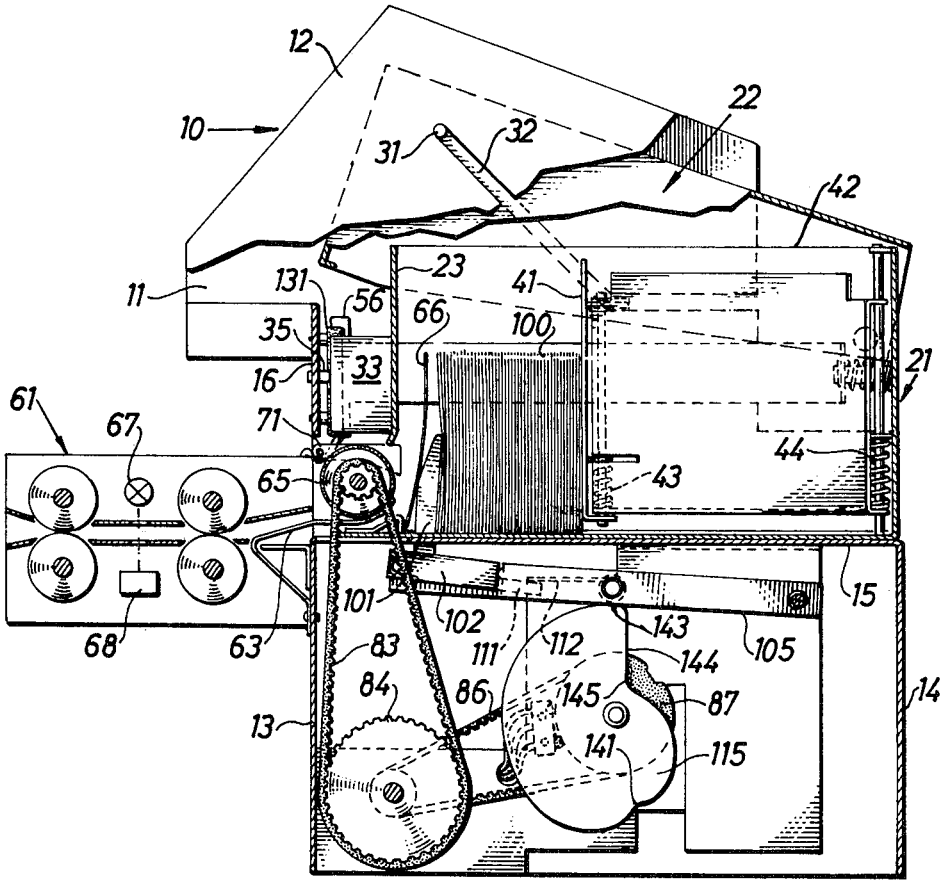
FIG. 3 is a side elevational sectional view as in FIG. 1 but with said drive and actuating means in a working condition, an object just being received in the casette.

The casette 20 is provided with a locking device for (upon activation) automatically locking the the cover 22 when brought into said closed position. The locking device includes an activable (by pin 35 on cross element 16; FIGS. 1–3) locking mechanism 33 on the front wall 23 and a key-operated locking latch mounted at 34 in the depending front plate of the cover 22. Since said locking device may be any suitable locking device it has not been shown in detail. However, suitably the locking device can be of the type described in the Swedish patent application No. 74-09523-3, the disclosure of which is hereby incorporated by reference.

Inside the casette 20 there is provided spring push means including a first vertical plate 41 extending parallel to the front wall 23 and at one end hinged to one end of a second vertical plate 42, the other end of which is hinged at an opposite rear corner of the box 21. A first spring 43 (FIGS. 2 and 3) bears against said first and second plates 41, 42 and a second spring 44 bears against said second plate 42 and the back wall of the box 21, such that said plates are forced towards the front end of the casette. Suitably, the movements of said plates 41, 42 are restricted, such that when the casette is empty the first plate 41 is located a suitable distance from and parallel to the front wall 23.

When the casette 20 is filled with banknotes, said plates 41 and 42 are pushed backwards against the actions of said springs 43, 44. When the casette becomes completely filled, the second plate 42 will engage a stop mechanism (cf. also FIG. 5) including a displaceably arranged bar 51 extending along one side wall of the box 21 from a mounting and guiding pin 52 fixed to the rear wall of the box and out through a guiding opening in the front wall 23 of the box. The inside end of said bar 51 has an inwardly angled end portion 53 provided with an opening corresponding to and penetrated by said mounting and guiding pin 52, a coil spring 54 on said pin 52 urging said end portion 53 and thus the bar 51 towards the normal end position shown in FIG. 4. The outside end of said bar 51 is provided with an angled portion 56 constituting an electromagnetic screen, the function of which will be described later in connection with FIG. 5. Briefly, however, when the casette 20 becomes completely filled, plate 42 will engage said end portion 53 and push said bar 51 rearwards against the action of spring 54, thereby displacing said screen portion 56 rearwards such that a stop function is released.

Referring now to FIGS. 1–3, showing the casette 20 received in the frame structure 10, it may be seen that the dimensions of the casette are in conformity with the dimensions of said upper room for receiving the casette. Thus, the dimensions of the extended bottom wall 25 of the casette generally are the same as those of the horizontal casette supporting plate 15.

In the operating position shown in FIGS. 1–3 obviously the cover 22 of the casette 20 must be in a raised position so as to enable banknotes to be fed into the casette through the intake opening 24. In order to achieve an automatic raising of the cover 22 when the casette is brought into the frame structure 10, the upper portions of the side plates 11, 12 of the frame structure are provided with slots 32 for cooperation with said projecting guide pin 31 on the depending side plates of the cover 22. Each of the slots 32 includes a horizontal rear portion open rearwards to enable insertion of said guide pins 31 and an upwards inclined front portion for raising said guide pins and thereby turning the cover 22 upwards. Of course, the opposite effect is achieved when the casette is withdrawn.

The means for feeding banknotes into the casette 20 will now be described in more detail. Said means include a feeding path 61 having a number of pairs of rolls for feeding a banknote therebetween, a flexible guide plate 63 and a feeding roller 65.

The feeding path 61 suitably can be part of the conventional feeding means for feeding verified banknotes from the banknote verifier (not shown) and, being of a conventional design, should not need to be described in detail. However, said feeding path 61 includes a modification in the form of detector means for detecting the front end of a banknote 66 being fed towards the apparatus according to the invention. Said detector means suitably include a light source 67 positioned on one side of the banknote path and a cooperating light detector 68 positioned on the other side of the banknote path and arranged to give an output signal, when the light path between the light source 67 and the light detector 68 is interrupted by a banknote.

The feeding roller 65 extends between the front portions of the side plates 11, 12 of the frame structure 10 just above the front end portion of the horizontal plate 15 and, when the casette 20 is received in the frame structure, just above the bottom wall extension 26 of the casette box 21 and immediately in front of the intake opening 24. The feeding roller 65 is provided with a number of periferal rubber feeding rings 69 for engagement with the surface of a banknote to be fed into the casette 20.

The flexible guide plate 63, not shown in FIG. 3 for the sake of clarity, extends below the feeding roller but above said guide elements 29 on the bottom wall extension 26.

The rear free end of the flexible guide plate 63 is curved upwards and has a number of slots in alignment with the slots 27 and 28 of the casette box 21. The intermediate portions of said rear free end of the guide plate 63 lie between said feeding rings 69, thereby ensuring proper feeding of a banknote passing between said feeding rings and said flexible guide plate.

Said feeding rings 69 and said rear curved end of the flexible guide plate 63 extend into the intake opening 24, such that a banknote 66 is fed into the casette to a position from which the banknote can fall down behind said guide elements 29.

In order to prevent engagement between banknotes in the casette 20 and the portions of said feeding rings 69 extending into the intake opening 24, when said banknotes are pushed against the intake opening by said spring push means 41–44 (FIG. 2), stop means 71 are provided. Said stop means 71 are rotatably arranged on a horizontal shaft 72 extending between the side plates 11, 12 in front of the feeding roller 65 and extend into the casette through the intake opening to hold the banknotes away from the feeding roller. The stop means 71 extend substantially horizontal by being supported in corresponding grooves 73 in the feeding roller 65. For each stop means there is a corresponding short vertical slot 74 extending from the intake opening 24 in the front wall 23 of the casette box 21. Thus, the stop means can rotate upwards to a certain extent during the feeding in of a banknote, if necessary.

The feeding roller 65 is driven by an electric motor 81 via a belt transmission including an intermediate shaft 82, said motor 81 and said shaft 82 being arranged in the lower room defined by the frame structure 10. A first cogged belt 83 runs around cog wheels 84, 85 fastened to the feeding roller 65 and the intermediate shaft 82, respectively. A second cogged belt 86 runs around cog wheels 87, 88 fastened to the motor shaft and the intermediate shaft, respectively. The motor cog wheel 87 is provided with a peripheral cam flange surface 89 cooperating with the operating arm of a microswitch 90, the function of which will be described later.

The means for actuating banknotes previously collected in the casette 20 (banknote stack 100 in FIGS. 1–3) include four actuating fingers 101 corresponding to the slots 27, 28 of the casette box 21 and projecting from a first support plate or lever 102, such that they are in alignment with said slots 27, 28 when the casette 20 is received in the frame structure. Correspondingly arranged openings or slots are provided in the front portion of the horizontal frame plate 15 to enable the fingers 101 to be brought from the lower room in the frame structure 10 into the casette via said slots 27, 28.

At its front end said first support plate 102 is journalled on a first horizontal shaft 103 arranged at the front end of a second support plate or lever 105. Said second support plate 105 is journalled at its rear end on a second shaft 106 extending horizontally at the rear end of the frame structure. Thus, the fingers 101 are arranged between said first and second shafts 103, 106, the distance between the fingers and the first shaft 103 being small relative to the distance between the fingers and the second shaft 106.

A coil spring (not shown) is arranged on the first shaft 103, said spring acting to turn the first support plate 102 counter-clockwise around said first shaft 103. At its rear end the first support plate 102 is provided with a projection 111 arranged for cooperation with a fixed stop 112. Also, suitable stop means (not shown) are arranged at said openings in the front portion of the horizontal plate 15 to limit the counter-clockwise turning movement of the fingers 101, when the fingers are in a lowered position as will be described later. When raised into the position shown in FIG. 2, the fingers 101 engage corresponding grooves in the feeding roller 65 (FIG. 1).

Drive means for the second support plate 105 include a vertical cam plate 115 fixed on the motor shaft 116 and a cam follower 117 mounted on the second support plate 105 at one side thereof for cooperation with the periphery of said cam plate 115.

The electric motor 81 is energized via the micro-switch 90 (FIG. 5), one motor lead 121 being connected to the switching element 122 of said micro-switch and the other motor lead 123 being connected to earth. The switching element 122 can be switched between two positions. In a start position, as shown in FIGS. 2 and 5, the switching element 122 is connected to a start lead 124 for receiving a motor start pulse of limited duration from the detector 68 (FIG. 2). In the start position, as shown in FIG. 2, the operating arm of the micro-switch 90 engages a recess in the peripheral cam flange surface 89. When, upon receipt of a start pulse, the motor 81 starts and rotates the cog wheel 89 with its cam flange as well as the cam plate 115, the operating arm of the micro-switch 90 is brought up onto the non-recessed portion of said cam flange surface 89, thereby switching the switching element 122 into an operating position, that is into contact with a power source lead 125. Consequently, the motor 81 will be energized until the operating arm of the micro-switch again engages said recess in the peripheral cam flange surface 89, that is after one revolution of the cog wheel 87 and the cam plate 115.

FIG. 5 also schematically illustrates the stop mechanism for stopping further receiving and collecting of banknotes when the casette 20 is completely filled. As previously described in connection with FIG. 4, said mechanism includes a displaceable bar 51 having an angled front end portion 56 outside of the casette. Normally, as illustrated in FIG. 5, said end portion extends into a screening position between a permanent magnet 131 and a reed-relay 132, both of which are mounted ajacent each other on the rear side of the front cross element 16, as shown in FIGS. 1 and 2. The reed-relay 132 includes a normally closed contact 133, that is closed when said bar end portion 56 screens the reed-relay relative the permanent magnet 131 such that the magnetic field cannot influence the reed-relay. The contact 133 is connected to two leads 134, 135 being part of an activating circuit of the previously mentioned banknote verifier and feeding means. Thus, when the casette becomes completely filled with banknotes such that the bar end portion 56 is withdrawn from between the permanent magnet 131 and the reed-relay 132, the contact 133 is opened and said banknote verifier and feeding means are deactivated. Of course, said activating circuit should include suitable means for preventing deactivation during the feeding in of a banknote accepted by the banknote verifier. Since such an activating circuit easily can be designed by anybody skilled in the art, no closer description thereof should be necessary.

An operating sequence of the apparatus disclosed will now be described starting from the rest or starting condition of the apparatus shown in FIG. 2. Said rest or starting position means that the motor drive mechanism is at rest in a position such that the projection 111 of the first support plate 102 has just come into engagement with the fixed stop 112. The fingers 101 rest in the corresponding grooves of the feeding roller 65.

Now, when a verified banknote 66, fed by the previously mentioned conventional feeding means, interrupts the light path between the light source 67 and the light detector 68, a start pulse is generated on lead 124, causing the motor 81 to be started and energized for one revolution, as previously described. Thus, the feeding roller 65 begins to rotate counter-clockwise, driven by the belt transmission. Also the cam plate 115 begins to rotate counter-clockwise acting on the cam follower 117. Initially, the cam follower 117 and a second support plate 105 is somewhat lowered due to a recess 141 in the cam plate 115, and recess 141 being provided to facilitate the start-up of the rotational movement of motor 81. Thereafter, the cam follower 117 and the second support plate 105 are raised again, thus causing the fingers 101 to be turned clockwise around the first shaft 103, due to the engagement between the projection 111 and the stop 112. At the same time the fingers are somewhat further raised.

During this movement the fingers 101 push the banknote stack 100 backwards against the action of the spring push means 41–44, thereby providing a free space inside the intake opening 24 of the casette box 21.

When the cam plate 105 has rotated about a quarter of a revolution, that is the cam follower engages the cam plate at 142 (FIG. 2), the raising action of the cam plate ceases, because the periphery of the cam plate here turns into a circle periphery terminating at 143. During the further rotation of the cam plate 115 into the position shown in FIG. 3, that is with the cam follower 117 engaging the cam plate 115 at 143, the banknote 66 has been fed into the free space provided between the fingers 101 and the front of the casette box 21. While being fed into the free space the banknote 66 is guided into vertical position by the end portion of the flexible guide plate 63 and the front edges of the fingers 101.

Further rotation of the cam plate 115 causes the fingers 101 to be lowered together with the support plates 102, 105 due to the almost radial periphery portion 144 of the cam plate. When the cam follower 117 engages the cam plate at 145, corresponding to a lowest position of the fingers 101, the fingers are completely outside the casette box 21, thereby enabling the spring push means 41–44 to push the banknote stack 100 forwards into engagement with the banknote 66, said banknote 66 being pushed against front plate 23, stop means 71 and the rear side of guide elements 29. The fingers 101 rest against suitable stop means at the openings in the horizontal plate 15, as previously mentioned.

Finally, the operating sequence is completed in that the cam plate 115 is rotated the rest of one revolution, thereby bringing the fingers 101 and the rest of the apparatus into the starting position shown in FIG. 2, in which the apparatus is automatically stopped by means of micro-switch 90, as previously described. The apparatus is now ready to receive and collect the next banknote while repeating the sequence described.

It will be understood the various changes and modifications in the apparatus, which has been described and illustrated in order to explain the nature of the invention, may be made by those skilled in the art within the principle and scope of the invention as expressed in the appended claims. For instance, a limited number of banknotes may be fed into the free space provided in the casette during each operating sequence.

I claim:

1. Apparatus for receiving and collecting sheet-shaped objects representing a value in a vending machine, said apparatus comprising: a container for collecting said objects, said container comprising a removable and lockable cassette having an intake opening and resilient means for pushing existing objects in the container towards the intake opening, said cassette cooperating with the remainder of the apparatus such that the cassette is substantially closed when in the apparatus; means for locking said cassette before removal from the apparatus; feeding means for feeding successively received objects through said intake opening into the container; and actuating means including a number of finger-shaped means movably suspended outside the container and means for displacing said finger-shaped means through corresponding openings in at least one wall of the container into engagement with existing objects in the container for temporarily compressing and/or displacing said existing objects such that a free space is provided in the container adjacent said intake opening, said feeding means being arranged to feed at least one object into said free space, such that said object will be put together with said existing objects when the temporary compressing and/or displacing action of said actuating means stops.

2. An apparatus according to claim 1, characterized by means for temporarily activating said actuating means each time a received object is in a predetermined position relative to said feeding means.

3. An apparatus according to claim 1, characterized in that said finger-shaped means are arranged to be displaced into the container to a position substantially parallel to said existing objects in the container and, thereafter, to be displaced essentially towards said objects in a direction away from said intake opening.

4. An apparatus according to claim 1, characterized in that said finger-shaped means are fixed on first support means turnably mounted on second support means by means of first shaft means, that said second support means are turnably suspended by means of second shaft means, that means are provided to turn said second support means around said second shaft means such that said finger-shaped means are brought into a position substantially parallel to said existing objects in the container, and that means are provided to turn said first support means around said first shaft means essentially when said finger-shaped means have been brought into said parallel position such that said finger-shaped means are brought into engagement with said existing objects to provide said free space.

5. An apparatus according to claim 4, characterized in that said means for turning said first support means around said first shaft means include stop means arranged to cooperate with said first support means during the last phase of the turning movement of said second support means.

6. An apparatus according to claim 5 characterized in that said means for turning said second support means include motor-operated cam means cooperating with said second support means.

7. An apparatus according to claim 4, characterized in that said means for turning said second support means include motor-operated cam means cooperating with said second support means.

8. A method of receiving and collecting sheet-shaped objects representing a value in a container, said objects being fed successively into said container through an intake opening, said method comprising:

a. subjecting existing objects in the container to a resilient pushing action in the direction of the intake opening;

b. introducing finger-shaped actuating means into said container, before feeding in an additional object, to compress said existing objects in the container against said resilient pushing action to displace said existing objects in a direction away from said intake opening to provide a free space in the vicinity of said intake opening, said finger-shaped actuating means being introduced into said container by turning said fingers around an axis relatively far from said fingers, and free space being produced by introducing the finger-shaped actuating means such that said fingers are in a plane substantially parallel to said existing objects and then causing said actuating means to move toward the planes of said existing objects away from said intake opening;

c. guiding an additional object through said intake opening into said free space into a predetermined position in the container;

d. causing said finger-shaped actuating means to move away from said intake opening by rotating said fingers about an axis relatively close to said finger-shaped actuating means; and e. causing said additional object to be put together with the existing objects by urging said existing objects toward the intake opening by said resilient pushing action.

9. A method according to claim 8 characterized by introducing said actuating means through openings provided in at least one of the walls of the container.

10. A method according to claim 8, characterized by using finger-shaped actuating means, said free space being provided by first introducing said actuating means, such that said actuating means substantially are in a plane parallel to said existing objects in the container, and thereafter causing said actuating means to move essentially towards the planes of said existing objects in said direction away from said intake opening.

11. A method according to claim 10, characterized by introducing said actuating means into the container essentially by turning said actuating means around an axis relatively far away from said actuating means, and by causing said actuating means to move away from said intake opening essentially by turning said actuating means around an axis relatively close to said actuating means.

12. A method according to claim 8 wherein the container is a closed container.

* * * * *